US007451509B2

(12) United States Patent
Dawes

(10) Patent No.: US 7,451,509 B2
(45) Date of Patent: Nov. 18, 2008

(54) ENHANCER DEVICE FOR ENHANCING THE UTILITY OF A USER'S BED

(76) Inventor: Jordan Dawes, 533 Vernon Ave., Unit B, Venice, CA (US) 90291

( * ) Notice: Subject to any disclaimer, the term of this patent is extended or adjusted under 35 U.S.C. 154(b) by 0 days.

(21) Appl. No.: 10/781,301

(22) Filed: Feb. 18, 2004

(65) Prior Publication Data

US 2005/0081296 A1 Apr. 21, 2005

Related U.S. Application Data

(60) Provisional application No. 60/512,130, filed on Oct. 17, 2003.

(51) Int. Cl.
*A47C 31/00* (2006.01)

(52) U.S. Cl. ..... 5/929; 5/662; 5/621; 5/505.1

(58) Field of Classification Search ..... 5/929, 5/621–624, 648–651, 658–659, 662, 426, 5/503.1, 505.1, 507.1, 646, 647; 248/125.7–125.9, 248/326, 333, 338, 106, 521, 458
See application file for complete search history.

(56) References Cited

U.S. PATENT DOCUMENTS 247,403 A * 9/1881 Pistorius ..... 5/646
795,903 A * 8/1905 Foster ..... 5/606
924,075 A * 6/1909 Johnson ..... 5/630
1,011,150 A * 12/1911 Brennan ..... 5/648
1,082,808 A * 12/1913 Hubbard ..... 248/106
1,546,813 A * 7/1925 Thomsen ..... 601/45
1,565,191 A * 12/1925 Nelson ..... 135/90
2,015,280 A * 9/1935 Buichi ..... 248/451
2,057,811 A * 10/1936 Armstrong ..... 5/662
2,557,570 A * 6/1951 Wright ..... 248/104
2,696,963 A * 12/1954 Shepherd ..... 248/229.15
2,722,692 A * 11/1955 Gretchen ..... 5/646
2,736,131 A * 2/1956 Lewis, Jr. ..... 446/227
2,783,758 A * 3/1957 Trott ..... 602/33
2,788,062 A * 4/1957 Bryant ..... 297/411.23
2,792,266 A * 5/1957 Waters ..... 5/624
2,891,257 A * 6/1959 Posey ..... 5/651
2,909,345 A * 10/1959 Toshio ..... 248/106
3,068,859 A * 12/1962 Treutelaar ..... 602/32
3,077,613 A * 2/1963 Mayer ..... 482/139
3,274,998 A * 9/1966 Grier, Jr. ..... 602/23
3,662,750 A * 5/1972 Jorgensen ..... 602/35
3,693,617 A * 9/1972 Trott ..... 602/40
3,745,996 A * 7/1973 Rush, Sr. ..... 602/39
3,826,490 A * 7/1974 Mossman ..... 482/94
3,889,910 A * 6/1975 Walters ..... 248/122.1
4,561,549 A * 12/1985 Yokohori ..... 211/182
4,616,637 A * 10/1986 Caspari et al. ..... 602/39

(Continued)

*Primary Examiner*—Sunil Singh
(74) *Attorney, Agent, or Firm*—Tope-McKay & Associates

(57) ABSTRACT

The present invention relates to an enhancer device, and more particularly, to an enhancer device for enhancing the utility and look of a user's bed. The enhancer device comprises a support member securing mechanism for securing the enhancer device; a support member detachably attached with the support member securing mechanism, the support member having a base end and a distal end; and a fastener connected with the distal end of the support member. Once secured, an attachment may be connected with the fastener. The attachment allows a user to support a body part, or alternatively, display decorative or items, thereby enhancing the utility and look of the user's bed.

21 Claims, 7 Drawing Sheets

U.S. PATENT DOCUMENTS 4,809,687 A * 3/1989 Allen ..... 602/4
5,127,898 A * 7/1992 McConnelll ..... 602/36
5,415,160 A * 5/1995 Ortiz et al. ..... 600/230
5,868,694 A * 2/1999 Marlow et al. ..... 602/32
5,957,135 A * 9/1999 Molina ..... 128/845
5,978,991 A * 11/1999 Miles ..... 5/651
6,588,037 B1 * 7/2003 Eno et al. ..... 5/419
6,698,044 B2 * 3/2004 Greenfield et al. ..... 5/624
2003/0182726 A1 * 10/2003 Greenfield et al. ..... 5/648
2003/0233707 A1 * 12/2003 East ..... 5/613
2004/0181877 A1 * 9/2004 Miller ..... 5/622
2004/0199996 A1 * 10/2004 Newkirk et al. ..... 5/81.1 R
2005/0022301 A1 * 2/2005 Thaxton ..... 5/81.1 R

* cited by examiner

ENHANCER DEVICE FOR ENHANCING THE UTILITY OF A USER'S BED

PRIORITY CLAIM

This application is a non-provisional application, claiming the benefit of priority to Provisional Application No. 60/512,130, filed in the United States on Oct. 17, 2003, and entitled "Stirrup Device."

BACKGROUND OF THE INVENTION (1) Technical Field

The present invention relates to an enhancer device, and more particularly, to an enhancer device for enhancing the utility and look of a user's bed.

(2) Related Prior Art

Throughout history, a bed has been used for sleeping, sexual intercourse, and as a place to rest for health. In order to enhance a utility of the bed, a variety of apparatus and tools have been conceived. For example, straps and slings are well known and have been used in many activities and have been produced in many forms. Straps and slings have been used in medical offices for medical examinations and in people's homes for medical limb support for recuperation after an injury or surgery. They have also been used during sexual activities to support body parts, such as buttocks, legs, and hands.

Devices have been proposed for use during conjugal relations and are responsive to manipulation or control by a partner to establish a predetermined relation or movement between the partners. Such devices can be used as a novelty, a toy, an enhancer, and an aid. They can also be used when one partner suffers a physical impairment or limitation that otherwise may inhibit or prohibit conjugal relations. Such prior devices include the following:

U.S. Pat. No. 784,425, issued to Phillips, discloses a portable stirrups device which comprises: (1) a flat support surface for placement on a table or bed and for supporting the buttocks of the user; (2) stirrups or foot-rests that are secured to the flat support; and (3) a clamping mechanism for rigidly securing the device to the bed, i.e., for clamping to the side rail of a bed.

U.S. Pat. No. 828,007, issued to Williams, discloses a portable and collapsible operating table that comprises: (1) an intermediate portion for supporting the buttocks/back of a patient and (2) integral and rigid foot rests including heel rests. The device can be placed on a bed or bench or even used as a stretcher.

U.S. Pat. No. 1,894,739, issued to Gilbert, also discloses a portable and collapsible surgical operating table having a foldable central portion for supporting the buttocks or back of the patient and which includes knee rests, rather than foot rests.

U.S. Pat. No. 2,978,713, issued to Scalizitti et al., discloses a portable examining table that comprises a central flat support portion upon which the patient lies and which anchors the table on a bed without the need for any mechanical attachment to the bed (col. 3, lines 5-7). A pair of knee rests are adjustably coupled to respective upstanding side portions.

U.S. Pat. No. 3,227,439, issued to Carlson, discloses an operating table that utilizes leg support portions that pivot about a vertical axis. Similar patents include U.S. Pat. No. 3,227,440, issued to Scott, and U.S. Pat. No. 4,239,200, issued to Sarrafian et al. Stirrups having leg holders that laterally pivot are shown in U.S. Pat. No. 358,513, issued to Walton.

U.S. Pat. No. 3,907,270, issued to Ezzo, discloses a portable examining table that comprises a central flat support for placement on a table with a transverse/bent and leg support member rotatably secured to one end of the flat support. A pair of molded plastic stirrups is fixed on opposite side of the transverse leg support. When the examining table is placed on a table or other surface along with the transverse/bent support member, the patient, with the buttocks on the central portion, can slip her feet into the stirrups.

U.S. Pat. No. 4,940,286, issued to Nguti, discloses a bed attachment that comprises a buttocks support section and having right and left support sections that can pivot in a lateral direction to assist in sexual activity, especially for arm amputees or other handicapped individuals.

U.S. Pat. No. 6,101,652, issued to Matern, Jr., discloses foldable leg stirrups for use during sex or medical examination that can be concealed, after use, between the mattress/box spring of a bed, or under the seat cushion(s) of a couch or chair, or between the mattress/cushion and frame of an examination table.

However, it is apparent that none of these devices can be used proximate the bed without the strength, support, or style that the new invention can offer. Thus, there remains a need for an enhancer device that can work in accordance with a bed for enhancing the utility of the bed.

SUMMARY OF THE INVENTION

The present invention relates to an enhancer device and; more particularly, to an enhancer device enhancing the utility and look of a user's bed. The enhancer device comprises a support member securing mechanism for securing the enhancer device with a material; a support member detachably attached with the support member securing mechanism, the support member having a base end and a distal end; and a fastener connected with the distal end of the support member.

The support member is pivotally connected with the support member securing mechanism through an attachment portion, thereby allowing the support member to rotate in relation to a fixed support member securing mechanism. A stop mechanism is attached with the enhancer device, such that when the stop mechanism is utilized the support member is prevented from pivoting in relation to the support member securing mechanism.

The stop mechanism comprises a slot at the base end of the support member and a projection projecting from the attachment portion. The projection is positioned such that it can mate with the slot, whereby when the projection mates with the slot, the support member is prevented from pivoting in relation to the support member securing mechanism.

In another aspect, the enhancer device further comprises an attachment detachably connected with the fastener. The attachment is an item selected from a group consisting of a strap, a handle, a chain, a handcuff, a sling, a candle holder, a light, and a plant holder.

In another aspect, the attachment is a handcuff, with a portion of the handcuff constructed of a material selected from a group consisting of metal, leather, fur, rope, plastic, nylon, composite, and fiber.

In yet another aspect, the attachment is a strap, with a portion of the strap constructed of a material selected from a group consisting of leather, fur, rope, plastic, nylon, composite, and fiber.

Additionally, the attachment is an elongated strap and is connected with the fastener of a first enhancer device and with the fastener of a second enhancer device, thereby allowing the elongated strap to be used as a seat and elevate a user above a bed's surface.

Furthermore, the attachment is a body sling with a plurality of attachment parts for attaching with the fasteners of a plurality of enhancer devices, whereby utilization of the body sling allows a body of a user to be elevated above a bed's surface.

In yet another aspect, the support member is tubular and is constructed of a material selected from a group consisting of metal, plastic, nylon, composite, and fiber. The support member includes an arcuate section terminating at the distal end, the arcuate section is shaped such that it appears as half of a simple heart shape, whereby when two enhancer devices are placed together, a combination of their support members forms a full heart shape.

Additionally, the support member securing mechanism is substantially flat, allowing the support member securing mechanism to be placed between a mattress and a box spring, thereby securing the enhancer device with a user's bed.

Furthermore, the enhancer device further comprises an adjuster connected with the support member, whereby a height of the enhancer device can be selectively adjusted to accommodate different sizes and heights of tables, mattresses and users. The adjuster is a mechanism selected from a group consisting of telescoping tubes and pin-adjusted tubes.

Finally, it can be appreciated by one in the art that the above summary of the enhancer device is not meant to be limiting and can be applied to various aspects of the present invention, such as a kit for building the same, where each individual part is configured to be connected with the respective connecting part.

BRIEF DESCRIPTION OF THE DRAWINGS

The objects, features and advantages of the present invention will be apparent from the following detailed descriptions of the preferred aspect of the invention in conjunction with reference to the following drawings, where.

DETAILED DESCRIPTION

The present invention relates to an enhancer device, and more particularly, to an enhancer device for enhancing the utility and look of a user's bed.

The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein, may be applied to a wide range of aspects. Thus, the present invention is not intended to be limited to the aspects presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

Figures 1, 2:
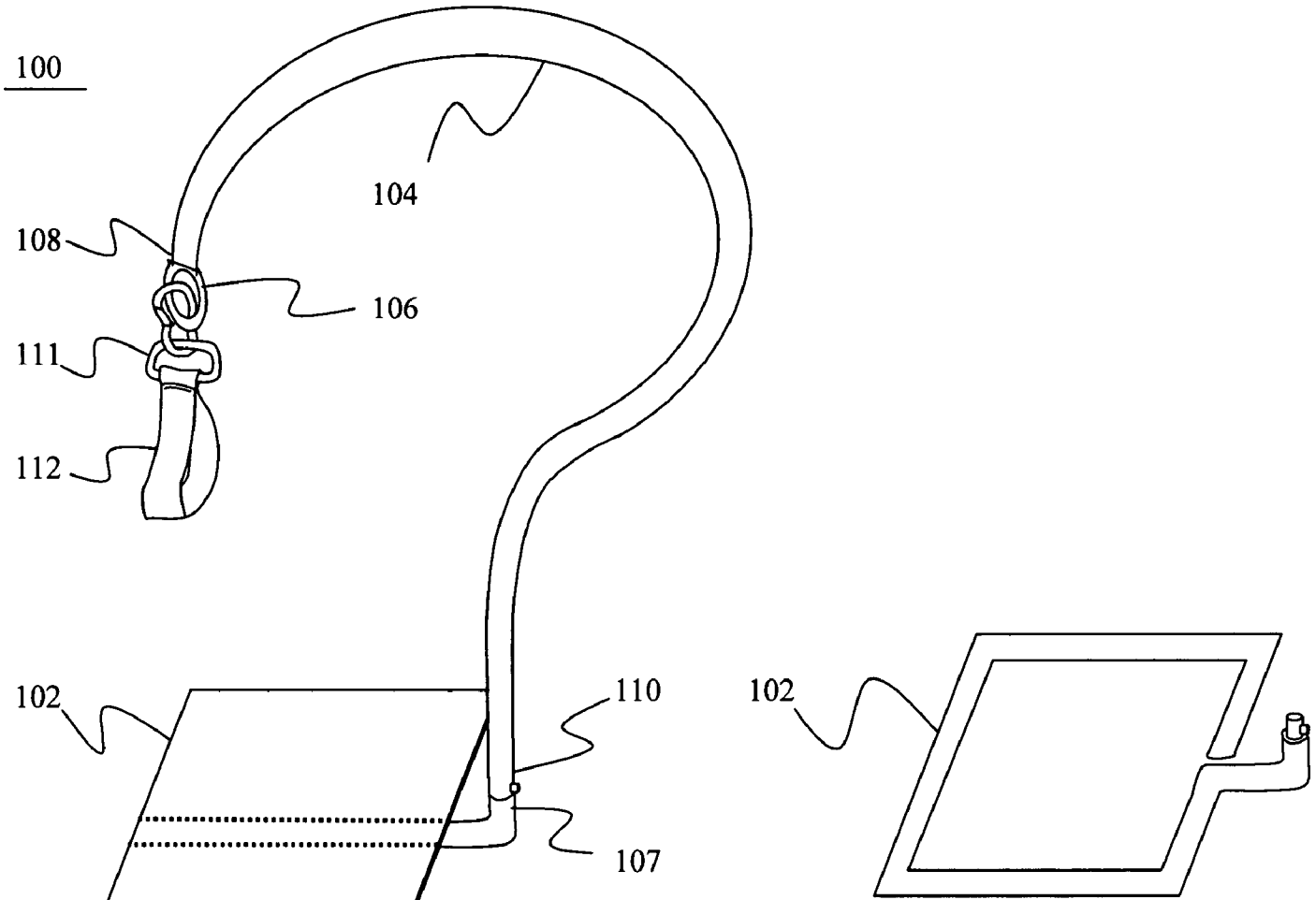
FIG. 1 is an illustration of an enhancer device according to the present invention.
FIG. 2 is an illustration of a support member securing mechanism according to the present invention.

Referring now to the figures, FIG. 1 illustrates an enhancer device 100 according to the present invention. The enhancer device 100 comprises a support member securing mechanism 102, a support member 104, a fastener 106, an intervening connector 111, and an attachment 112.

The support member securing mechanism 102 may be constructed in any suitable shape and secured in any suitable manner, non-limiting examples of which include the support member securing mechanism 102 being secured with a bed, being secured with a floor, and being secured with a ceiling. For example, the support member securing mechanism may be plate configured to be bolted to a ceiling or floor, or alternatively may be the concrete floor itself in which the support member 104 is cemented. As another example, the support member securing mechanism 102 is for securing the enhancer device 100 with a user's bed. In this aspect, the support member securing mechanism 102 is substantially flat or planar, allowing it to be sandwiched, or disposed, in the area between a box spring and a mattress of a bed or examination table (not shown). In this aspect, weight from the mattress and from a user upon the mattress secures the support member securing mechanism 102 with the bed.

The support member securing mechanism 102 also includes a coupler 107 for attaching with the support member 104. The support member securing mechanism 102 is constructed of any suitably rigid material, non-limiting examples of which include metal and plastic. In addition, the support member securing mechanism 102 may take a variety of forms, non-limiting examples of which include a plate, as shown in FIG. 1, and bent tubes/solid bars, as shown in FIG. 2.

The support member 104 has a distal end 108 and a base end 110. The base end 110 of the support member 104 is connected with the coupler 107. The coupler 107 and support member 104 are shown as tubular or cylindrical, but can take other configurations without departing from the invention. Furthermore, the support member 104 is constructed of any suitably rigid or flexible material, non-limiting examples of which include metal and plastic. Strength and safety are crucial, but flexible or rigid support members 104 may be used.

The fastener 106 is connected with a distal end 108 of the support member 104. The fastener 106 may be any suitable mechanism or device for attaching one object with another, a non-limiting example of which includes a hook, a hoop, and a ring that can rotate relative to the support member 104. An intervening connector 111 may be attached with the fastener 106. The intervening connector 111 may be any suitable mechanism or device for attaching one object with another, non-limiting examples of which include a ring, a hoop, and a clip such as those used on swing-sets. The intervening connector 111 is constructed such that it can be permanently affixed or selectively removed from the fastener 106 and replaced by a user. Through use of the intervening connector 111, a user may selectively connect an attachment 112 with the fastener 106 to support a body part or a decorative item, thereby enhancing the utility and look of the user's bed. In addition, the intervening connector 111 can be separate or integral with the attachment 112. The attachment 112 may be any suitable mechanism or device for enhancing the utility of a user's bed, non-limiting examples of which include a strap, a handle, a chain, a handcuff, a sling, a candle holder, a light source, and a plant holder. In order to alter the feel, strength and comfort of the attachment 112, a portion of the attachment 112 may be constructed of any suitable material, non-limiting examples of which include metal, leather, fur, rope, plastic, foam, nylon, composite, and fiber.

Figure 3:
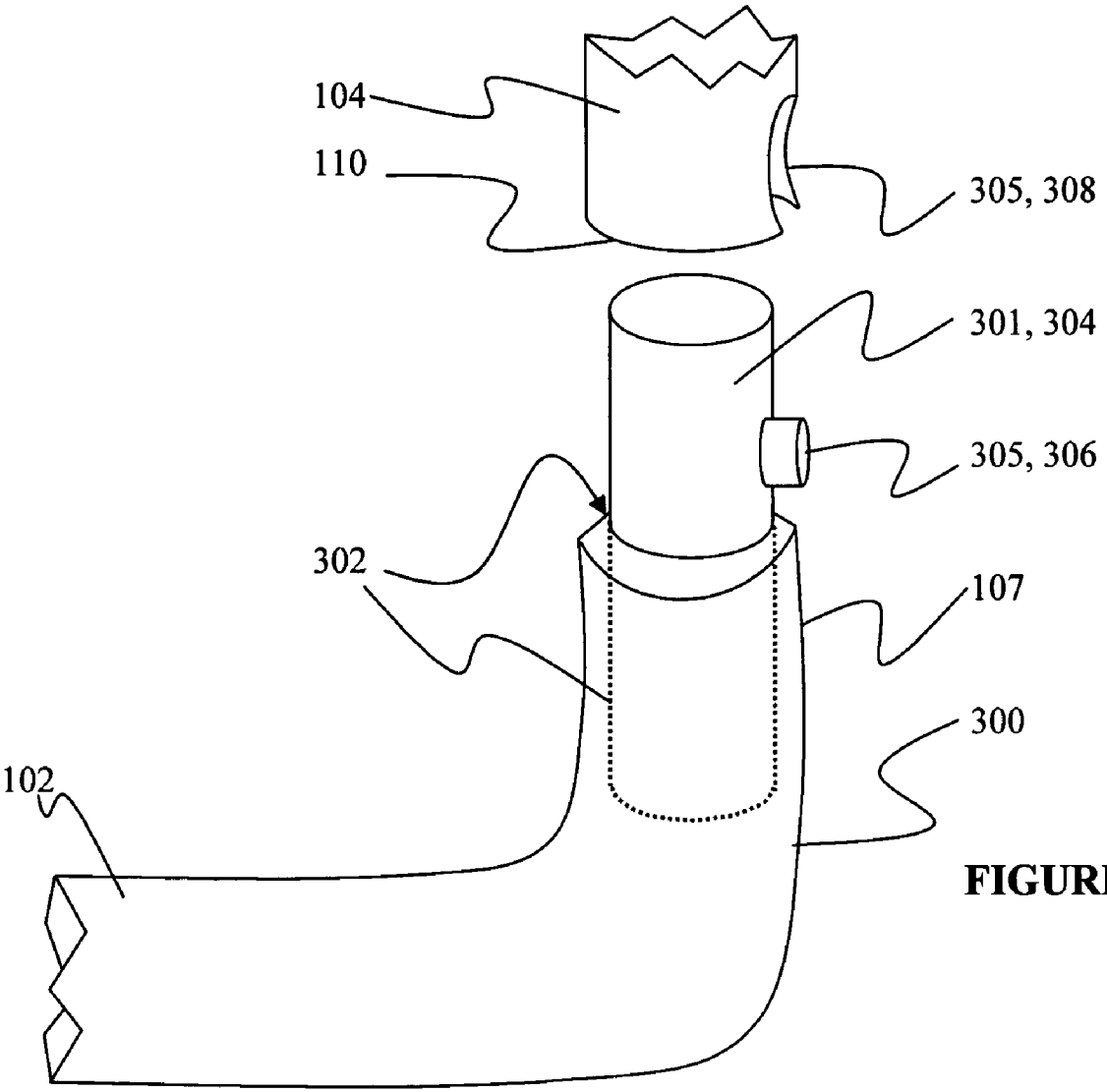
FIG. 3 is an illustration of a coupler of a support member securing mechanism according to the present invention.

FIG. 3 illustrates a support member securing mechanism 102 having a coupler 107 for detachably attaching with a base end 110 of the support member 104. The support member 104 may be fixedly connected or pivotally connected with the coupler 107. The coupler 107 is secured to or integrally formed with the support member securing mechanism 102 and supports and holds the support member 104. Specifically, the coupler 107 includes an elbow 300 with an attachment portion 301 for connecting the coupler 107 with the support member 104. The attachment portion 301 may be any suitable configuration for connecting the support member 104 with the coupler 107. As non-limiting examples, the attachment portion 301 may be integrally connected with the coupler 107, or alternatively, the coupler 107 may have an opening 302 to receive an insert 304, with the insert 304 functioning as the attachment portion 301. Once connected, the support member 104 is permitted to rotate relative to the attachment portion 301, the coupler 107 and the support member securing mechanism 102 by conventional and known means. In order to prevent rotation between the support member 104 and the attachment portion 301, the coupler 107, and the support member securing mechanism 102, a stop mechanism 305 is attached with the enhancer device 100. The stop mechanism 305 is any suitable mechanism, configuration, or device for stopping a pivotal motion between two objects. As a non-limiting example, the attachment portion 301 includes a projection 306 extending therefrom and the base end 110 of the support member 104 includes a slot 308. In this aspect, when the projection 306 interacts with the slot, the support member 104 is prevented from pivoting in relation to the coupler 107 and its support member securing mechanism 104.

It should further be understood that the pivotal coupling disclosed herein is by way of example only and that any equivalent means or method of pivotally coupling the support member securing mechanism 102 and the support member 104 is within the broadest scope of this invention.

Figure 4:
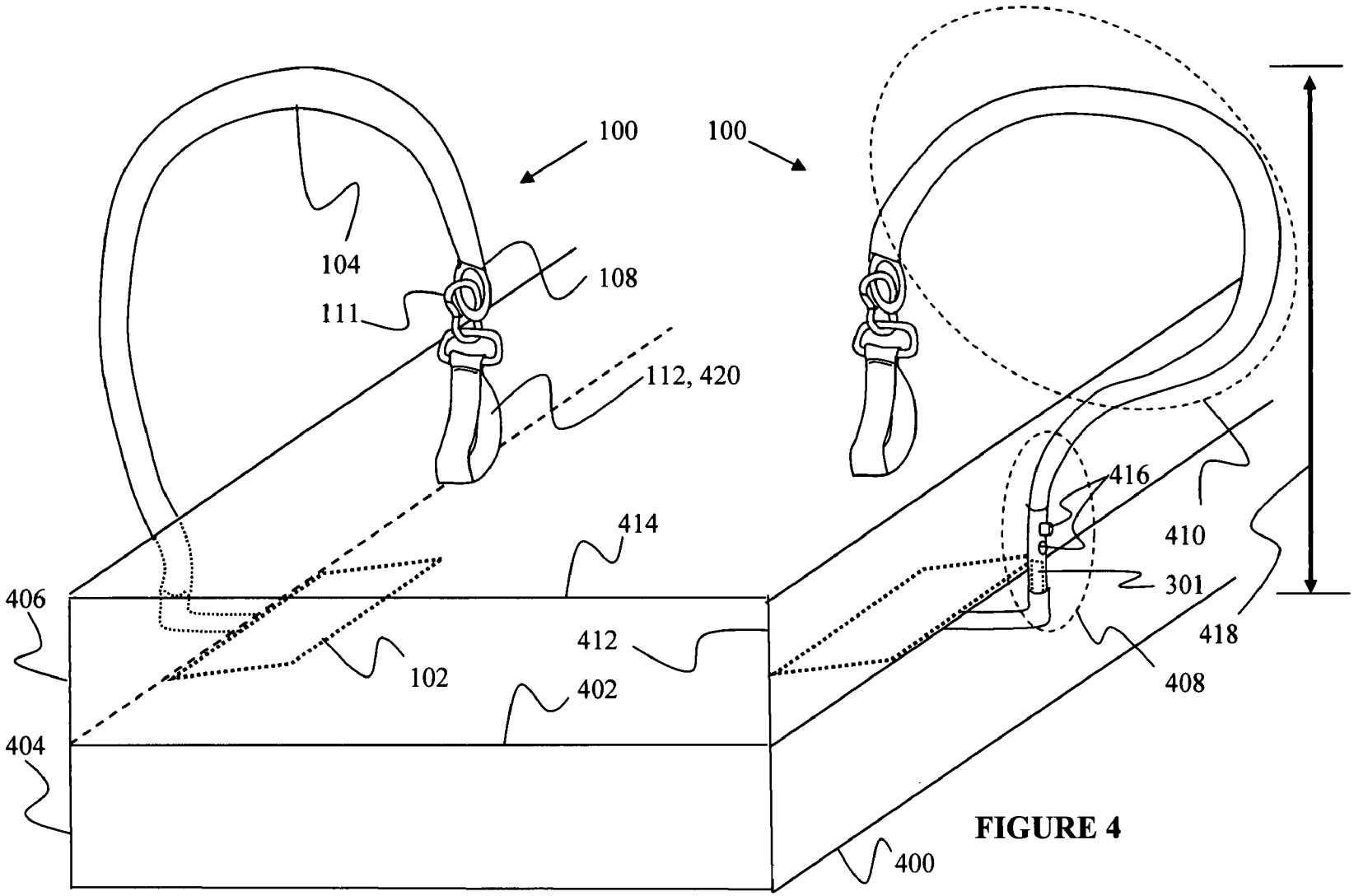
FIG. 4 is an illustration of two enhancer devices attached with a user's bed.

FIG. 4 illustrates a pair of enhancer devices 100 attached with a user's bed 400. As shown, the support member securing mechanism 102 is substantially flat or planar, allowing it to be sandwiched, or disposed, in the area 402 between a box spring 404 and a mattress 406 of a bed 400, thereby securing the support member securing mechanism 102 with the user's bed 400.

It should be understood that the bed mattress 406 and the box spring 404 shown in the figures are shown as examples and that the mattress 406 shown may also represent a cushion of a chair or couch, with the box spring 404 representing the chair or couch frame. Alternatively, the bed mattress 406 may represent an examination table mattress or cushion and the box spring 404 may represent the examination table frame.

Thus, the use of the device 100 is not limited to beds, chairs, couches, and examination tables, but rather includes any reclining, laying, or seating device where the user's legs or other body parts can be supported on the respective support members 104.

When affixed with a bed 400, weight of the mattress 406 holds the support member securing mechanism 102 in place. Being substantially flat, the support member securing mechanism 102 can be positioned in its usable position without disturbing the bed 400 or examination table. The removable support members 104 may be withdrawn from the support member securing mechanism 102, and the support member securing mechanism 102 may be left between the mattress 406 and box spring 404. When disconnected and not in use, the support member securing mechanism 102 may also be concealed under the cushions of a couch or between an examination table mattress and frame without disturbing the use of the couch or examination table. Because of their ability to be easily attached and separated, components of the enhancer device 100 can be separated during storage and easily assembled for use.

A first segment 408 of the support member 104 is designed to hug or follow a contour of the bed 400 and a contiguous arcuate hoop section 410 is to permit the distal end 108 to be aligned over the bed 400. In this manner, the support member 104 can project from the mattress 406 and box spring 404, running along a side 412 of the mattress 406 and then along a top surface 414 of the mattress 406.

The first segment 408 is shown to be straight, but it, too, can have an arc for added strength or appealing aesthetics. In addition, the first segment can have an adjuster 416 to adjust a height 418 to accommodate different sizes and heights of tables, mattresses and individuals. The adjuster 416 may be any suitable mechanism or device for selectively adjusting the height 418, non-limiting examples of which include telescoping, and pin-adjusting. Telescoping height adjustment mechanisms are commonly found in tripods used for cameras and video equipment. An inner tube rides within an outer tube and the two are locked together by a tightening mechanism. Pin-adjusting mechanisms are commonly used in adjustable canes and crutches and employ a spring biased pin within a first, inner tube that communicates with one of a plurality of holes in a second, outer tube. These, as well as other mechanism or devices may be used to selectively lift, lower and securely adjust the height 418 of the distal end 108 and hoop section 410 of the support member 104.

In operation, the support member 104 is pivoted above the support member securing mechanism 102 via the coupler 300 and attachment portion 301 to the desired position and location. A user places his/her buttocks either above the support member securing mechanism 102 when the enhancer device 100 is used on top of a bed, couch, chair, examination table, etc., or on the mattress 406 of the bed 400, examination table, etc., or on the cushion of the couch, chair, etc., under which the support member securing mechanism 102 is positioned (i.e., indirect use). Thus, the enhancer device 100 can be used either on top of the bed 400 or it can be used with the support member securing mechanism 102 positioned between the bed mattress 406 and box spring 404, or alternatively, under the cushions of a couch or chair. Next, once the attachment 112 is attached via the intervening connector 111, the enhancer device 100 is ready for use. When used in this aspect, the support member securing mechanism 102 is positioned below the user, allowing the user's weight to be transferred through the support member 104 to the support member securing mechanism 102.

As noted, several different attachments 112 can be secured or attached with the intervening connector 111. A looped foot rest 420 as shown in FIG. 4, can be employed to support a user's leg. The foot rest 420 provides pelvic control, relief of weight or pressure, and/or guidance for a more pleasurable position. The attachments 112 shown are by way of example only and it is envisioned that other attachments 112 may be used to support feet, arms, legs, and other limbs.

Upon finishing the use thereof, the device 100, along with the attachments 112, can then be either left in place, used for other purposes, or dismantled.

Figure 5:
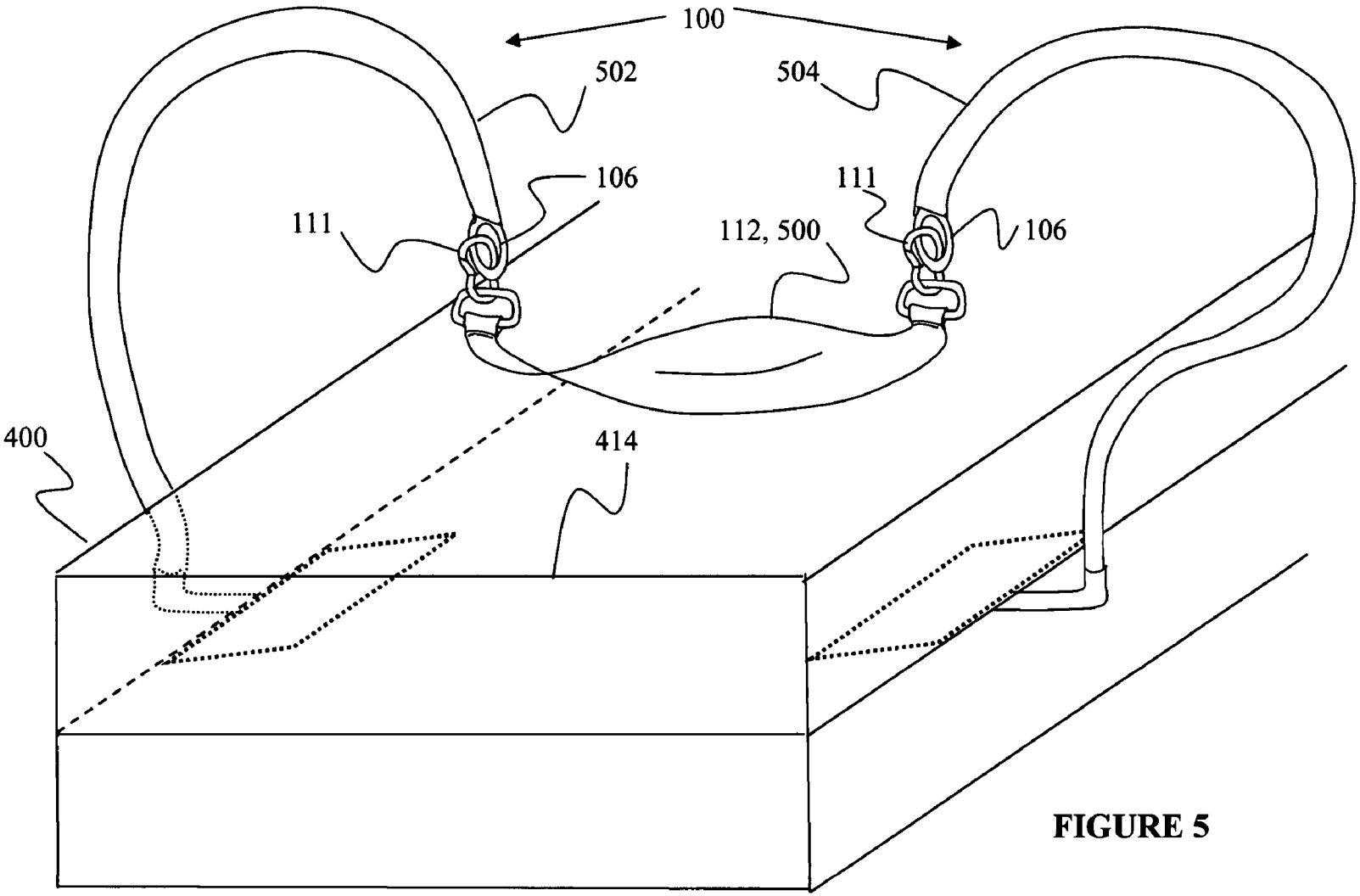
FIG. 5 is an illustration of an elongated strap connected with a fastener of a first enhancer device and with a fastener of a second enhancer device.

As shown in FIG. 5, a plurality of enhancer devices 100 may be connected together and used concurrently. For example, the attachment 112 may be an elongated strap 500. Through use of the intervening connectors 111, the elongated strap 500 is connected with the fastener 106 of a first enhancer device 502 and with the fastener 106 of a second enhancer device 504. Once connected with first 502 and second 504 enhancer devices, the elongated strap 500 can be used as a seat to elevate a user above the top surface 414 of the bed 400.

Figure 6:
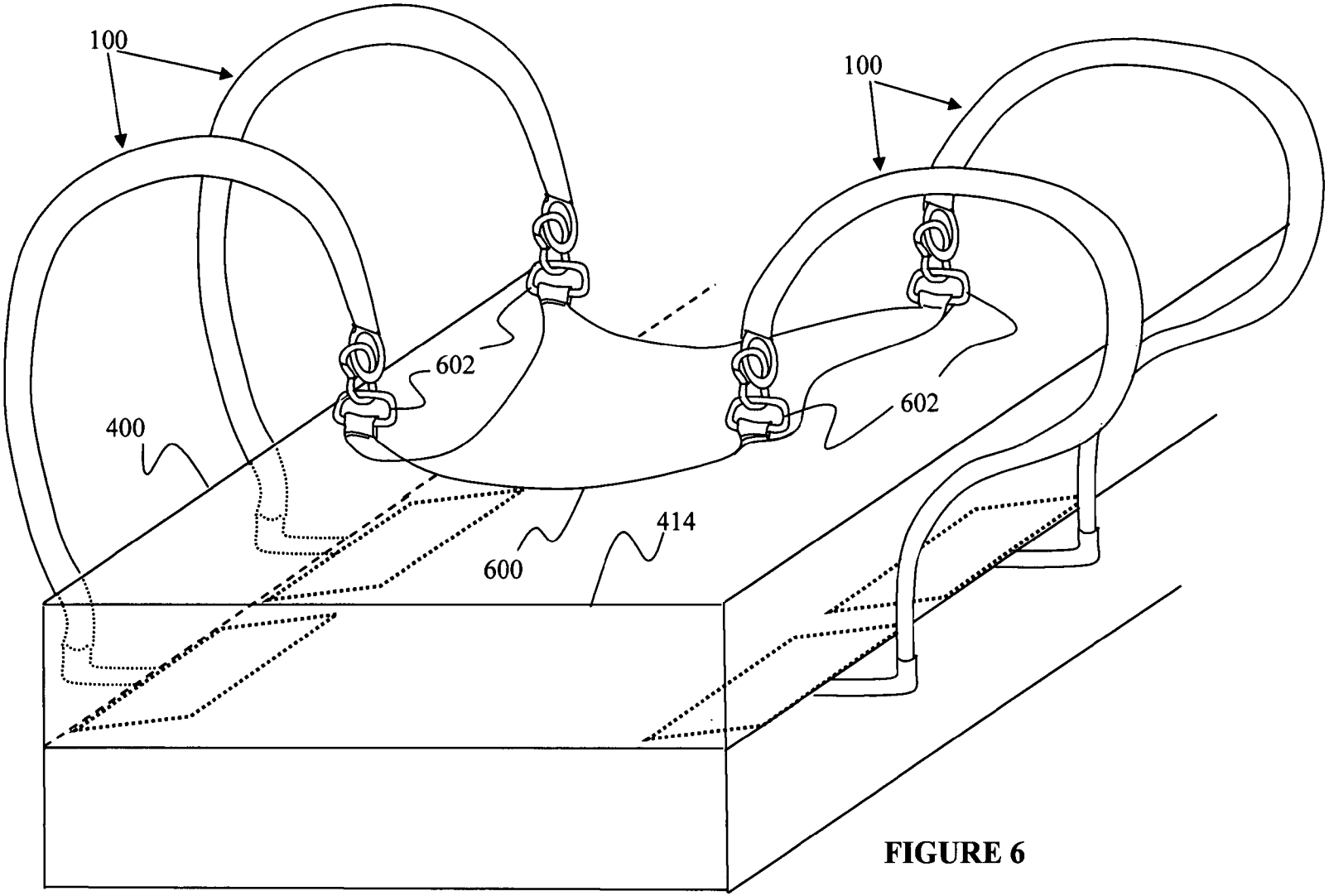
FIG. 6 is an illustration of a body sling attached with a plurality of enhancer devices.

In another aspect and as shown in FIG. 6, the attachment 112 may be a body sling 600 with a plurality of attachment parts 602 for attaching with a plurality of enhancer devices 100. For example, the body sling 600 may include four attachment parts 602 for attaching with four enhancer devices 100. Once appropriately attached, utilization of the body sling 600 allows a body of a user to be elevated above the top surface 414 of the bed 400.

Figure 7:
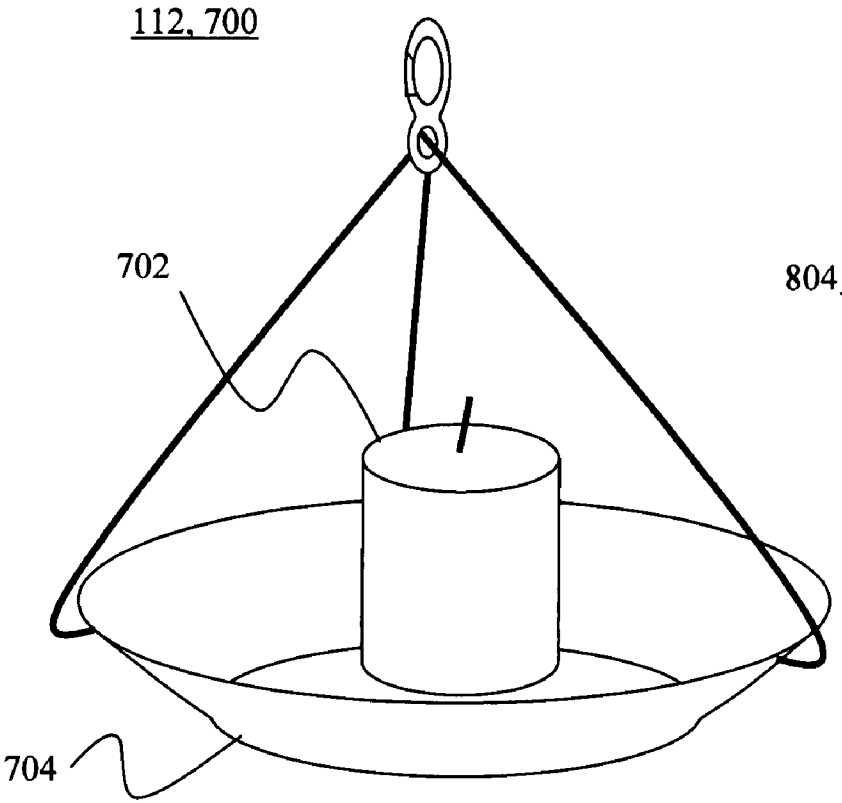
FIG. 7 is an illustration of a candle holder according to the present invention.

FIG. 7 illustrates another aspect of according to the present invention. In this aspect, the attachment 112 is a candle holder 700. The candle holder 700 may be formed in any suitable manner allowing the candle holder 700 to hold a candle 702. For example, the candle has a base portion 704 where the candle 702 may be placed. It can be appreciated that the candle holder 700 with its respective candle 702 may be attached with an enhancer device to enhance the beauty of a bedroom or to create a particular romantic setting.

Figure 8:
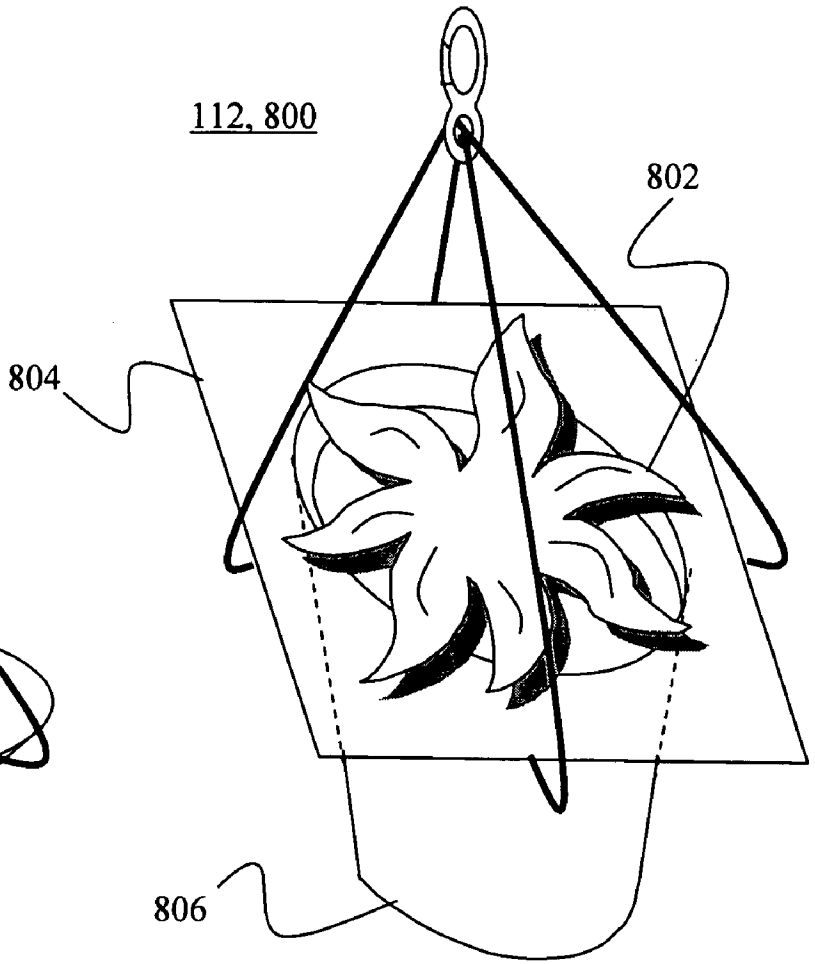
FIG. 8 is an illustration of a plant holder according to the present invention.

As shown in FIG. 8, the attachment 112 may be a plant holder 800. When a plant holder 800, the attachment 112 is formed in any suitable manner to hold a plant 802. For example, the plant holder 800 may have a plant base portion 804 with a recessed area 806, allowing the plant 802 to be placed therein. Because of its aesthetically pleasing features, instead of disassembling and concealing the enhancer device, one may choose to leave it assembled with the plant holder 800 in place.

Figure 9:
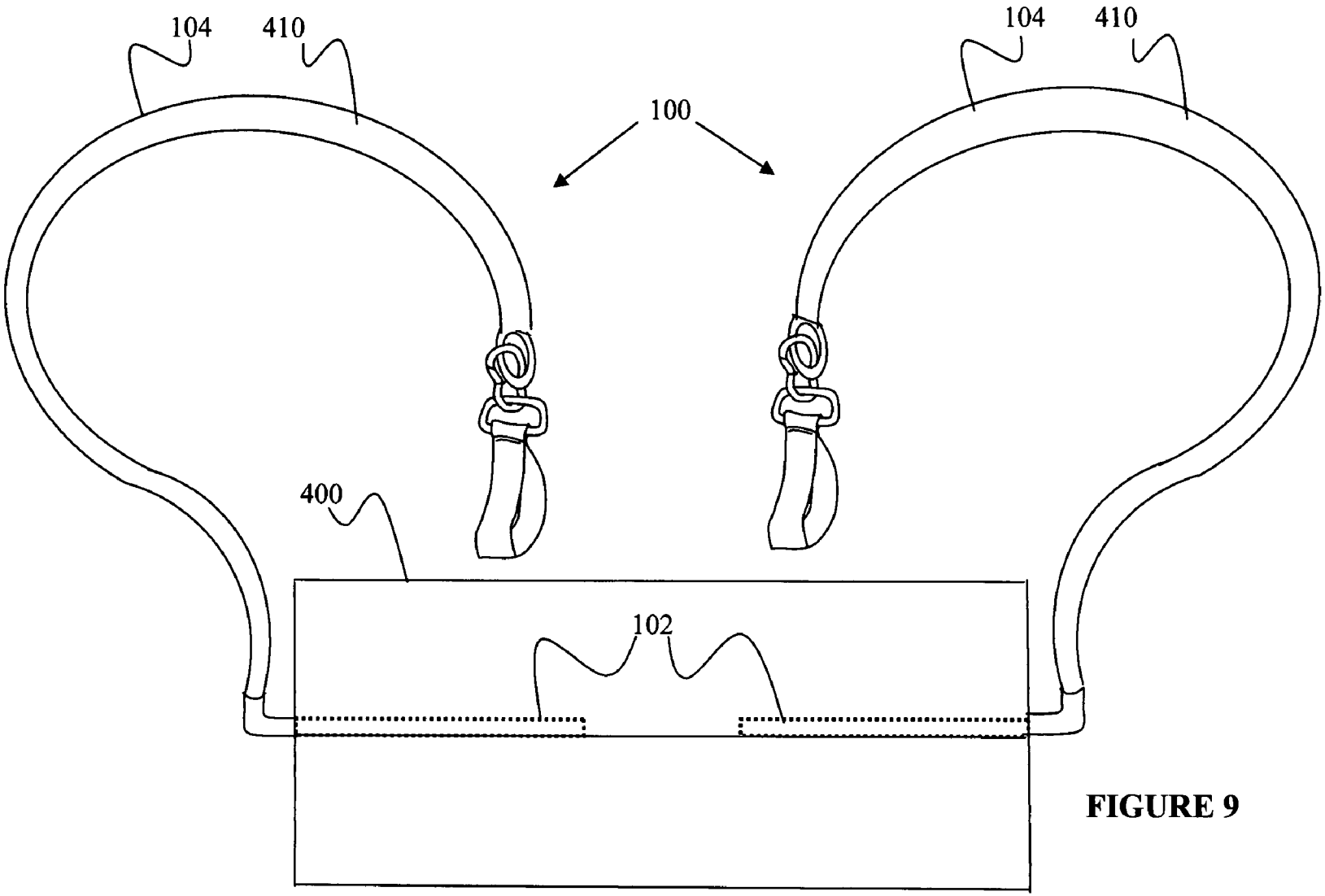
FIG. 9 is an illustration of a front view of two enhancer devices attached with a user's bed.

FIG. 9 illustrates a front view of two enhancer devices 100 attached with a user's bed 400. As shown, each support member 104 may be constructed so as to form or closely resemble a half of a simple heart. If a user places the support member securing mechanisms 102 adjacent one another in a co-planer fashion, the two hoop sections 410 together form the top of a heart. When positioned in this manner, it can be appreciated that the enhancer device 100 is aesthetically pleasing. As a result, if desired, instead of disassembling and concealing the enhancer device 100, one may choose to exhibit it as a piece of sculpture.

What is claimed is:

1. An enhancer device for enhancing the utility and look of a user's bed, the enhancer device comprising:

a pair of support members, each support member having a base end and a distal end;

two fasteners, each connected with the distal end of a support member, two support member securing mechanisms for attaching with the support members and securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size insufficient to maintain the support member securing mechanism affixed with the user's bed when a user's weight is positioned upon the support member; and further comprising an attachment for connecting with at least one of the two fasteners;

whereby using the support member securing mechanisms, a user may secure the enhancer device with a user's bed, allowing the user to thereafter connect the attachment with at least one of the two fasteners, thereby enhancing the utility and look of the user's bed;

wherein each support member securing mechanism further includes an attachment portion and wherein the support member is detachably attached with the attachment portion;

wherein each support member is pivotally connected with a support member securing mechanism, thereby allowing the support member to rotate in relation to a fixed support member securing mechanism;

further comprising a stop mechanism attached with the enhancer device, whereby when the stop mechanism is utilized the support member is prevented from pivoting in relation to the support member securing mechanism;

wherein the stop mechanism comprises a slot at the base end of each support member and a projection projecting from each attachment portion, the projection positioned such that it can mate with the slot, whereby when the projection mates with the slot, the support member is prevented from pivoting in relation to the support member securing mechanism; and wherein the attachment is an elongated strap and is connected with both of the two fasteners, thereby allowing the elongated strap to be used as a seat and elevate a user above a bed's surface.

2. An enhancer device for enhancing the utility and look of a user's bed, the enhancer device comprising:

a pair of support members, each support member having a base end and a distal end;

two fasteners, each connected with the distal end of a support member, two support member securing mechanisms for attaching with the support members and securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment for connecting with at least one of the two fasteners;

whereby using the support member securing mechanisms, a user may secure the enhancer device with a user's bed, allowing the user to thereafter connect the attachment with at least one of the two fasteners, thereby enhancing the utility and look of the user's bed;

wherein each support member securing mechanism further includes an attachment portion and wherein the support member is detachably attached with the attachment portion;

wherein each support member is pivotally connected with a support member securing mechanism, thereby allowing the support member to rotate in relation to a fixed support member securing mechanism;

further comprising a stop mechanism attached with the enhancer device, whereby when the stop mechanism is utilized the support member is prevented from pivoting in relation to the support member securing mechanism;

wherein the stop mechanism comprises a slot at the base end of each support member and a projection projecting from each attachment portion, the projection positioned such that it can mate with the slot, whereby when the projection mates with the slot, the support member is prevented from pivoting in relation to the support member securing mechanism; and further comprising a third support member, the third support member having a base end and a distal end;

a third fastener connected with the distal end of the third support member, the two fasteners and the third fastener constituting a plurality of fasteners;

a third support member securing mechanism attached with the third support member;

wherein the attachment is a body sling with a plurality of attachment parts, each of the attachment parts being formed to be attached with a fastener such that the body sling can be attached with the plurality of fasteners, whereby utilization of the body sling allows a body of a user to be elevated above a bed's surface.

3. An enhancer device as set forth in claim 2, wherein each support member is tubular; and further comprising a fourth support member, the fourth support member having a base end and a distal end;

a fourth fastener connected with the distal end of the fourth support member;

a fourth support member securing mechanism attached with the fourth support member;

wherein the third and fourth support members collectively form a second pair of support members, such that the body sling can be connected between the two fasteners, the third fastener, and the fourth fastener to effectively hold a user's body.

4. An enhancer device as set forth in claim 3, wherein each support member is constructed of a material selected from a group consisting of metal, plastic, nylon, composite, and fiber.

5. An enhancer device as set forth in claim 4, wherein each support member includes an arcuate section terminating at the distal end, the arcuate section is shaped such that it appears as half of a simple heart shape, whereby when two support members are placed together, their combination forms a full heart shape.

6. An enhancer device as set forth in claim 5, wherein each support member securing mechanism is substantially flat, allowing each support member securing mechanism to be placed between a mattress and a box spring, thereby securing the enhancer device with a user's bed.

7. An enhancer device as set forth in claim 6, further comprising an adjuster connected with each support member, whereby a height of the enhancer device can be selectively adjusted to accommodate different sizes and heights of tables, mattresses and users.

8. An enhancer device as set forth in claim 7, wherein the adjuster is a mechanism selected from a group consisting of telescoping tubes and pin-adjusted tubes.

9. An enhancer device for enhancing the utility and look of a user's bed, the enhancer device comprising:

a pair of support members, each support member having a base end and a distal end;

two fasteners, each connected with the distal end of a support member, two support member securing mechanisms for attaching with the support members and securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment for connecting with at least one of the two fasteners;

whereby using the support member securing mechanisms, a user may secure the enhancer device with a user's bed, allowing the user to thereafter connect the attachment with at least one of the two fasteners, thereby enhancing the utility and look of the user's bed; and further comprising an additional support member, the additional support member having a base end and a distal end;

an additional fastener connected with the distal end of the additional support member, the two fasteners and the additional fastener constituting a plurality of fasteners;

an additional support member securing mechanism attached with the additional support member;

wherein the attachment is a body sling with a plurality of attachment parts, each of the attachment parts being formed to be attached with a fastener such that the body sling can be attached with the plurality of fasteners, whereby utilization of the body sling allows a body of a user to be elevated above a bed's surface.

10. An enhancer device for enhancing the utility and look of a user's bed, the enhancer device comprising:

a pair of support members, each support member having a base end and a distal end;

two fasteners, each connected with the distal end of a support member, two support member securing mechanisms for attaching with the support members and securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment for connecting with at least one of the two fasteners;

whereby using the support member securing mechanisms, a user may secure the enhancer device with a user's bed, allowing the user to thereafter connect the attachment with at least one of the two fasteners, thereby enhancing the utility and look of the user's bed; and wherein each support member is constructed of a material selected from a group consisting of metal, plastic, nylon, composite, and fiber; and further comprising a second pair of support members, each of the second pair of support members having a base end and a distal end;

two additional fasteners, each connected with the distal end of one of the second pair of support members, the two fasteners and the two additional fasteners constituting a plurality of fasteners;

two additional support member securing mechanisms, each attached with one of the second pair of support members, for securing the second pair of support members with a user's bed;

wherein the attachment is a body sling with a plurality of attachment parts, each of the attachment parts being formed to be attached with a fastener such that the body sling can be attached with the plurality of fasteners, such that the body sling can be connected between the plurality of fasteners to effectively hold a user's body elevated above a bed's surface.

11. A kit for building an enhancer device, the kit comprising:

a pair of support members, each having a base end and a distal end;

two fasteners, each configured to be connected with the distal end of a support member;

further comprising two support member securing mechanisms, each configured to be attached with a support member, and wherein the support member securing mechanisms aid in securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment configured to be connected with at least one of the two fasteners;

whereby using both support member securing mechanisms, a user may secure the enhancer device with a user's bed, allowing the user to thereafter connect the attachment with at least one of the two fasteners, thereby enhancing the utility and look of the user's bed;

wherein each support member securing mechanism further includes an attachment portion, and wherein each support member is configured such that it is detachably attachable with the attachment portion;

wherein each support member is configured such that it may be pivotally connected with the support member securing mechanism, thereby allowing the support member to rotate in relation to a fixed support member securing mechanism;

further comprising a stop mechanism attached with the enhancer device, whereby when the stop mechanism is utilized the support member is prevented from pivoting in relation to the support member securing mechanism;

wherein the stop mechanism comprises a slot at the base end of each support member and a projection projecting from each attachment portion, the projection positioned such that it can mate with the slot, whereby when the projection mates with the slot, the support member is prevented from pivoting in relation to the support member securing mechanism; and further comprising:

a third support member, the third support member having a base end and a distal end;

a third fastener connected with the distal end of the third support member, the two fasteners and the third fastener constituting a plurality of fasteners;

a third support member securing mechanism configured to be attached with the third support member; and wherein the attachment is a body sling with a plurality of attachment parts, each of the attachment parts being formed to be attached with a fastener such that the body sling can be attached with the plurality of fasteners, whereby utilization of the body sling allows a body of a user to be elevated above a bed's surface.

12. A kit for building an enhancer device as set forth in claim 11, wherein each support member is tubular; and further comprising a fourth support member, the fourth support member having a base end and a distal end;

a fourth fastener connected with the distal end of the fourth support member, a fourth support member securing mechanism attached with the fourth support member;

wherein the third and fourth support members collectively form a second pair of support members, such that the body sling can be connected between the two fasteners, the third fastener, and the fourth fastener to effectively hold a user's body.

13. A kit for building an enhancer device as set forth in claim 12, wherein each support member is constructed of a material selected from a group consisting of metal, plastic, nylon, composite, and fiber.

14. A kit for building an enhancer device as set forth in claim 13, wherein each support member includes an arcuate section terminating at the distal end, the arcuate section is shaped such that it appears as half of a simple heart shape, whereby when two support members are placed together, their combination forms a full heart shape.

15. A kit for building an enhancer device as set forth in claim 14, wherein each support member securing mechanism is substantially flat, allowing each support member securing mechanism to be placed between a mattress and a box spring, thereby securing the enhancer device with a user's bed.

16. A kit for building an enhancer device as set forth in claim 15, further comprising an adjuster configured to be connected with each support member, whereby a height of the enhancer device can be selectively adjusted to accommodate different sizes and heights of tables, mattresses and users.

17. A kit for building an enhancer device as set forth in claim 16, wherein the adjuster is a mechanism selected from a group consisting of telescoping tubes and pin-adjusted tubes.

18. A kit for building an enhancer device, the kit comprising:

a pair of support members, each having a base end and a distal end;

two fasteners, each configured to be connected with the distal end of a support member;

further comprising two support member securing mechanisms, each configured to be attached with a support member, and wherein the support member securing mechanisms aid in securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment configured to be connected with at least one of the two fasteners;

whereby using both support member securing mechanisms, a user may secure the enhancer device with a user's bed, allowing the user to thereafter connect the attachment with at least one of the two fasteners, thereby enhancing the utility and look of the user's bed; and wherein the attachment is an elongated strap and is connected with both of the fasteners, thereby allowing the elongated strap to be used as a seat and elevate a user above a bed's surface.

19. A kit for building an enhancer device, the kit comprising:

a pair of support members, each having a base end and a distal end;

two fasteners, each configured to be connected with the distal end of a support member;

further comprising two support member securing mechanisms, each configured to be attached with a support member, and wherein the support member securing mechanisms aid in securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment configured to be connected with at least one of the two fasteners;

whereby using both support member securing mechanisms, a user may secure the enhancer device with a user's bed, allowing the user to thereafter connect the attachment with at least one of the two fasteners, thereby enhancing the utility and look of the user's bed; and further comprising an additional support member, the additional support member having a base end and a distal end;

an additional fastener connected with the distal end of the additional support member, the two fasteners and the additional fastener constituting a plurality of fasteners;

an additional support member securing mechanism attached with the additional support member;

wherein the attachment is a body sling with a plurality of attachment parts, each of the attachment parts being formed to be attached with a fastener such that the body sling can be attached with the plurality of fasteners, whereby utilization of the body sling allows a body of a user to be elevated above a bed's surface.

20. A kit for building an enhancer device, the kit comprising:

a pair of support members, each having a base end and a distal end;

two fasteners, each configured to be connected with the distal end of a support member;

further comprising two support member securing mechanisms, each configured to be attached with a support member, and wherein the support member securing mechanisms aid in securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member; and further comprising an attachment configured to be connected with at least one of the two fasteners;

whereby using both support member securing mechanisms, a user may secure the enhancer device with a user's bed, allowing the user to thereafter connect the attachment with at least one of the two fasteners, thereby enhancing the utility and look of the user's bed; and wherein each support member is constructed of a material selected from a group consisting of metal, plastic, nylon, composite, and fiber; and further comprising a second pair of support members, each of the second pair of support members having a base end and a distal end;

two additional fasteners, each connected with the distal end of one of the second pair of support members, the two fasteners and the two additional fasteners constituting a plurality of fasteners;

two additional support member securing mechanisms, each attached with one of the second pair of support members, for securing the second pair of support members with a user's bed;

wherein the attachment is a body sling with a plurality of attachment parts, each of the attachment parts being formed to be attached with a fastener such that the body sling can be attached with the plurality of fasteners, such that the body sling can be connected between the plurality of fasteners to effectively hold a user's body elevated above a bed's surface.

21. An enhancer device for enhancing the utility and look of a user's bed, the enhancer device comprising;

two pairs of support members, each support member having a base end and a distal end;

four fasteners, each connected with the distal end of a support member, four support member securing mechanisms, each attachable with a support member, for securing the enhancer device with a user's bed;

wherein when each support member is attached with a support member securing mechanism, the distal end of each support member extends laterally over the attached support member securing mechanism;

wherein each of the support member securing mechanisms is substantially planar for placement between a user's box spring and a user's mattress, and being formed to be detachably attached with a single support member;

wherein each support member securing mechanism is of a size such that when connected with a support member, the support member securing mechanism extends laterally beyond the distal end of the support member, and where the size is such that when the support member securing mechanism is positioned between the user's box spring and a mattress having weight, and when the support member is affixed with the support member securing mechanism, the support member securing mechanism remains affixed with the user's bed through the weight of the mattress alone, and where the size is sufficient to maintain the support member securing mechanism affixed with the user's bed when a user's weight is positioned upon the support member;

an attachment for connecting with and between each of the four fasteners; and wherein the attachment is a body sling with a plurality of attachment parts, each of the attachment parts being formed to be attached with a fastener such that the body sling can be attached with the four fasteners, such that the body sling can be connected between the four fasteners to effectively hold a user's body elevated above a bed's surface, whereby using the support member securing mechanisms, a user may secure the enhancer device with a user's bed, allowing the user to thereafter connect the attachment with the four fasteners, thereby enhancing the utility and look of the user's bed.

* * * * *